US007928909B2

(12) United States Patent
Jung et al.

(10) Patent No.: US 7,928,909 B2
(45) Date of Patent: Apr. 19, 2011

(54) CONCURRENT MODE ANTENNA SYSTEM

(75) Inventors: Chang-won Jung, Hwaseong-si (KR); Young-eil Kim, Suwon-si (KR); Byung-tae Yoon, Suwon-si (KR); Yong-jin Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 542 days.

(21) Appl. No.: 11/744,258

(22) Filed: May 4, 2007

(65) Prior Publication Data

US 2008/0143607 A1 Jun. 19, 2008

(30) Foreign Application Priority Data

Dec. 18, 2006 (KR) ..... 10-2006-0129583

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/702, 343/803, 833, 834, 700 MS, 846
See application file for complete search history.

(56) References Cited

U.S. PATENT DOCUMENTS

| | | | | |
|---|---|---|---|---|
| 5,153,600 | A | 10/1992 | Metzler et al. | |
| 6,040,803 | A * | 3/2000 | Spall | 343/700 MS |
| 6,337,667 | B1 * | 1/2002 | Ayala et al. | 343/795 |
| 6,891,506 | B2 * | 5/2005 | Jarmuszewski et al. | 343/702 |
| 7,242,364 | B2 * | 7/2007 | Ranta | 343/860 |
| 7,450,072 | B2 * | 11/2008 | Kim et al. | 343/700 MS |

FOREIGN PATENT DOCUMENTS

| | | | |
|---|---|---|---|
| DE | 195 46 010 | A1 | 6/1997 |
| DE | 103 19 093 | | 11/2004 |
| EP | 1 011 167 | A1 | 6/2000 |
| EP | 1 619 752 | A1 | 1/2006 |
| KR | 10-2006-0100721 | A | 9/2006 |
| WO | 02/078123 | A1 | 10/2002 |
| WO | 2004/001898 | A1 | 12/2003 |

* cited by examiner

*Primary Examiner* — Shih-Chao Chen
(74) *Attorney, Agent, or Firm* — Sughrue Mion, PLLC

(57) ABSTRACT

A concurrent mode antenna system includes an antenna which generates a plurality of operating frequencies that are available at a same time, the antenna comprising a plurality of feed points; and a signal processing circuit which is connected to the feed points and processes radio signals transmitted and received by the antenna. Accordingly, the antenna system can not only provide various wireless services corresponding to the respective operating frequency bands on the single antenna but also miniaturize the antenna system. Furthermore, the antenna system can achieve the insertion loss prevention, the simplified structure, and the lower cost.

12 Claims, 7 Drawing Sheets

CONCURRENT MODE ANTENNA SYSTEM

CROSS-REFERENCE TO RELATED APPLICATIONS

This application is based on and claims priority from Korean Patent Application No. 10-2006-0129583 filed on Dec. 18, 2006, in the Korean Intellectual Property Office, the entire disclosure of which is incorporated herein by reference.

BACKGROUND OF THE INVENTION

1. Field of the Invention

Apparatuses consistent with the present invention relate to a concurrent mode antenna system, and more particularly, to a concurrent mode antenna system for enabling various radio communication services by transmitting and receiving radio signals of a plurality of frequency bands on a single antenna.

2. Description of the Related Art

Various radio communication services use wireless terminals such as mobile phones, personal digital assistants (PDAs), persona computers, and notebook computers, for example, Global System for Mobile communication (GSM), Personal Communication Services (PCS), World Interoperability for Microwave Access (WiMAX), Wireless Local Area Network (WLAN), Wireless Broadband Internet (WiBro), and Bluetooth.

GSM uses a 890~960 MHz band, the PCS uses a 1.8 GHz band, and WiMAX uses a 3.6~3.8 GHz band. WLAN uses a 2.4 GHz band which is the Industrial, Scientific & Medical (ISM) band in the IEEE 802.11b standard and a 5 GHz band which is the Unlicensed National Information Infrastructure (UNII) in the IEEE 802.11a standard. WiBro uses a 2.3 GHz band and Bluetooth uses a 2.4 GHz.

To use radio communication services at a single wireless terminal over the various frequency bands, the related art employs a multiband antenna system as shown in FIGS. 1 and 2.

The multiband antenna system in FIG. 1 includes a single antenna 10, a multiplexer 15 for separating signals from the antenna 10 into a plurality of frequency bands, $f_0$~$f_n$, and a plurality of radio frequency (RF) circuits 20 for processing the frequency band signals separated at the multiplexer 15.

The antenna system of FIG. 1, which uses the single antenna 10, can decrease the size of the antenna system but may be subject to the insertion loss due to the multiplexer 15. With the single antenna 10, only one radio communication service can be used at a time, because it is impossible to provide the corresponding radio communication services with respective frequency bands at the same time.

The multiband antenna system in FIG. 2 includes a plurality of antennas 50, a plurality of band pass filters (BPFs) 55, and a plurality of RF circuits 60. The antennas 50 transmit and receive signals in different frequency bands, $f_0$-$f_n$. The BPFs 55 filter the signals transmitted and received on the antenna 50 according to the intended frequency bands.

Using the multiple antennas 50 and the multiple BPFs 55, disadvantageously, the antenna system of FIG. 2 generates the insertion loss and increases the size of the antenna system.

Therefore, what is needed is a reconfigurable antenna system which can receive various radio communication services on a single antenna, use the radio communication services at the same time, and reduce the insertion loss of the conventional multiband antenna system that are due to the multiplexer 15 or the BPF 55.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a concurrent mode antenna system which enables to use a plurality of radio communication services on a single antenna and to use the radio communication services at the same time.

The present invention also provides a concurrent mode antenna system for simplifying its configuration and reducing an insertion loss.

According to an aspect of the present invention, there is provided a concurrent mode antenna system including an antenna generating a plurality of operating frequencies available at the same time and having a plurality of feed points; and a signal processing circuit connected to the feed points and processing radio signals transmitted and received on the antenna.

The signal processing circuit may be a plurality of RF circuits which process the radio signals.

The plurality of the RF circuits may correspond to the feed points respectively.

The antenna may comprise using a ground and a radiator of a strip line shape connected to the ground. A plurality of feed points may be formed to the radiator.

A port for connecting to the RF circuit may be formed to each feed point.

The radiator may include a first radiator formed as a strip line with one side bent; and a second radiator formed as a strip line bent toward the first radiator and parallel with the first radiator by a certain length.

The port may be connected to one of the ends of the first radiator or of the second radiator.

The first radiator may be formed by bending the strip line in a spiral shape.

The concurrent mode antenna system may further include an auxiliary radiator formed symmetrical to the first radiator and in parallel with the first radiator, the auxiliary radiator generating a coupling with the first radiator.

The second radiator may be formed as a strip line which bends several times around the first radiator and the auxiliary radiator, and the second radiator may generate a coupling with the first radiator and the auxiliary radiator.

The radiator and the ground may be disposed in respective sides of a dielectric substrate. The antenna system may further include a match part which is formed as a strip line extending from one side of the ground and electrically connected to the radiator through a via hole penetrating the dielectric substrate.

One of an open stub, a short stub, and an inductor/capacitor (LC) circuit may be mounted in one side of the strip line.

Lengths of the open stub and the short stub may be set to $\lambda/4$ of frequencies to be cut off.

An inductance of an inductor and a capacitance of a capacitor, constructing the LC circuit, may be determined according to the frequencies to be cut off.

BRIEF DESCRIPTION OF THE DRAWING FIGURES

The above and other aspects of the present invention will become more apparent and more readily appreciated by describing in detail exemplary embodiments thereof with reference to the attached drawings in which.

Figure 10A:
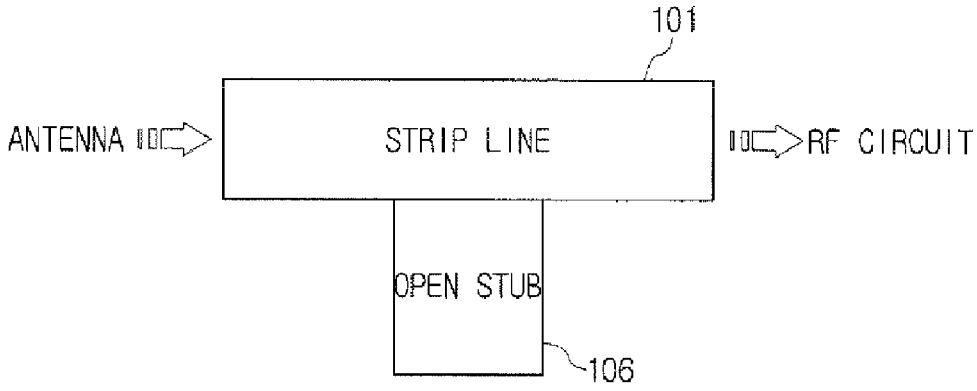
Figure 10B:
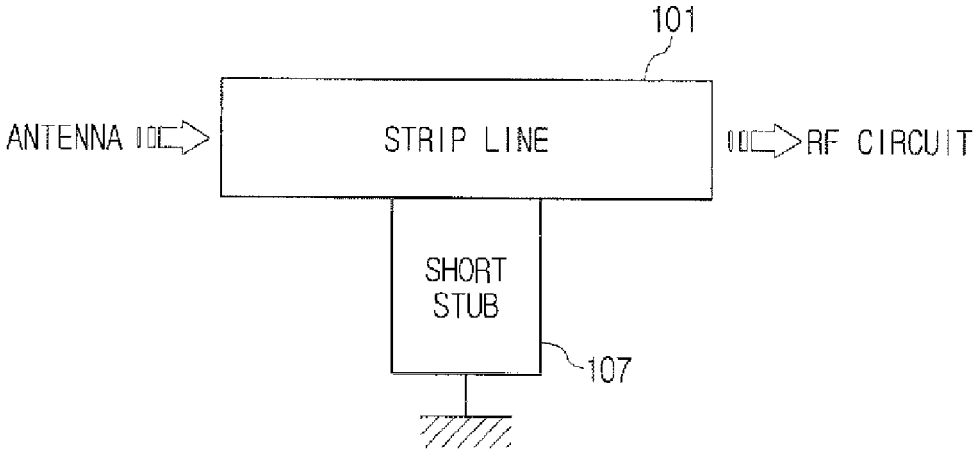
Figure 10C:
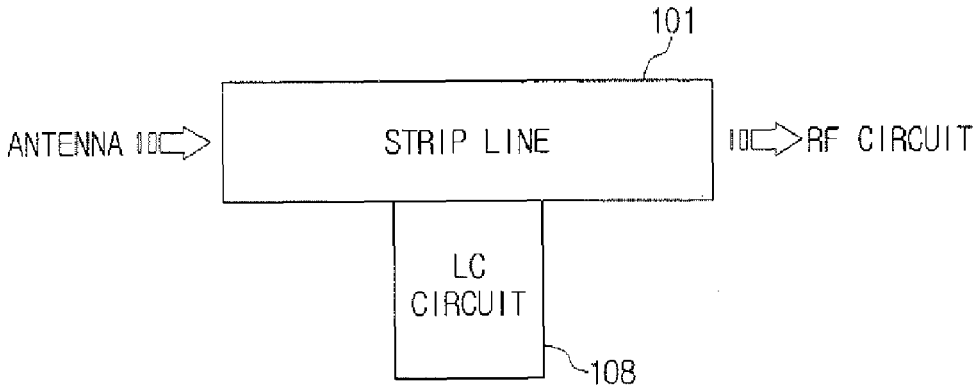
Figure 11:
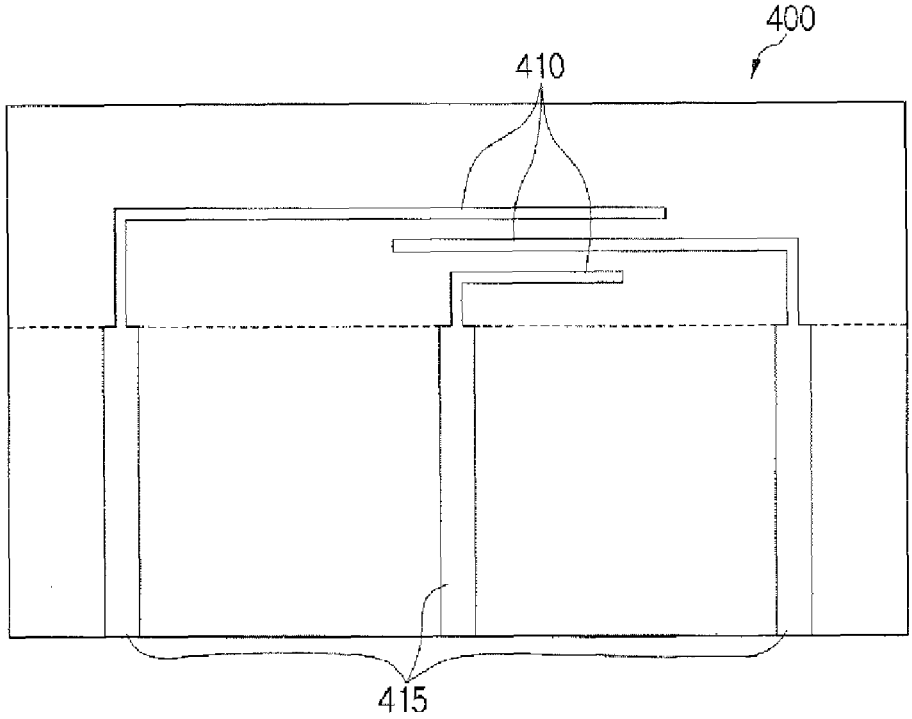

FIGS. 10A, 10B, and 10C are plane views of the antenna to which an open stub, a short stub, an LC circuit are mounted; and FIG. 11 is a plane view of an antenna according to yet another exemplary embodiment of the present invention.

DETAILED DESCRIPTION OF THE EXEMPLARY EMBODIMENTS

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

Figure 1:
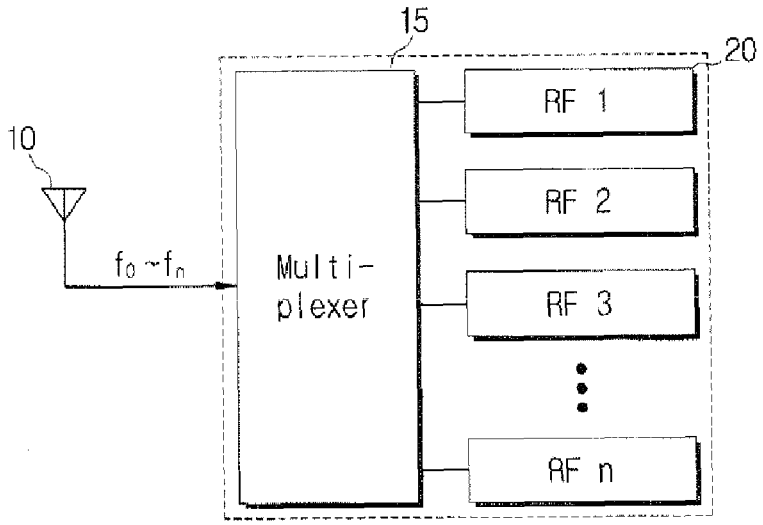
FIG. 1 (RELATED ART)
FIG. 1 is a simplified diagram of a related art multiband antenna system.
Figure 2:
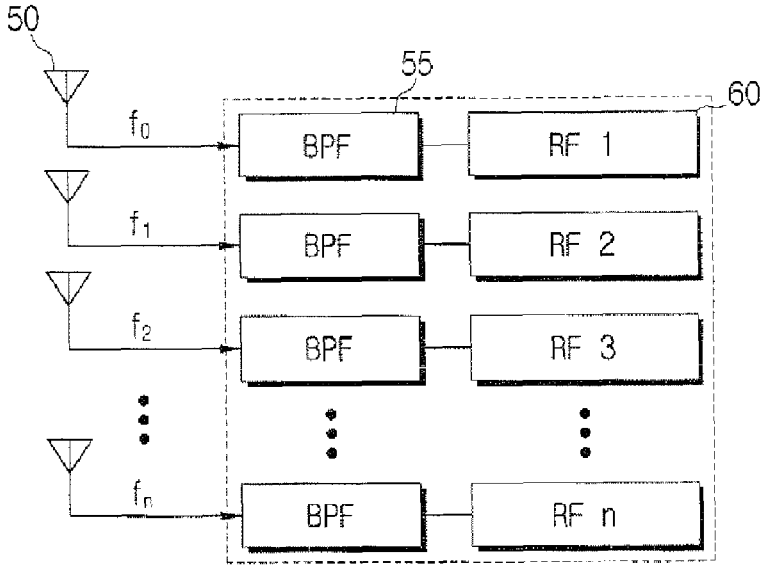
FIG. 2 (RELATED ART)
FIG. 2 is a simplified diagram of another related art multi-band antenna system.
Figure 3:
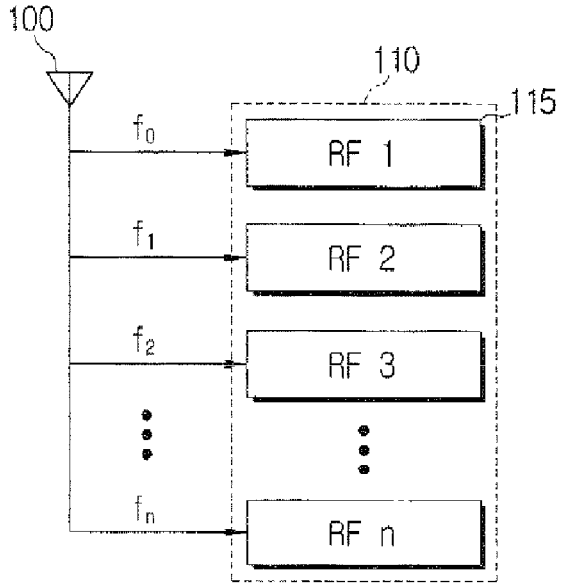
FIG. 3 is a block diagram of a concurrent mode antenna system according to an exemplary embodiment of the present invention.

FIG. 3 is a simplified block diagram of a concurrent mode antenna system according to an exemplary embodiment of the present invention.

The antenna system includes a single antenna 100 which transmits and receives signals of a plurality of frequency bands $f_0$-$f_n$, and a signal processing circuit 110 which processes the signals transmitted and received on the antenna 100.

The antenna 100 has a plurality of feed points. Through ports connected to the respective feed points, the signals of the frequency bands are transferred between the antenna 100 and the signal processing circuit 110. Herein, the signals corresponding to the respective frequency bands may be transferred one by one or in plural through the ports. At this time, the antenna 100 can operate in a concurrent mode to provide the signals through the respective ports at the same time. Note that the antenna 100 may selectively transmit and receive one or multiple signals provided through the ports.

The signal processing circuit 110 is connected to the ports of the antenna 100. The signal processing circuit 110 can be configured as a single RF circuit 115 or a plurality of RF circuits 115. When the signal processing circuit 110 consists of a single RF circuit 115, the RF circuit 115 is connected to the ports and configured as a reconfigurable circuit capable of processing the signals from the ports according to their frequency bands. When the signal processing circuit 110 is the plurality of RF circuits 115, the RF circuits 115 are connected to the corresponding ports and process the signals of the frequency bands transferable through the ports.

Figure 4:
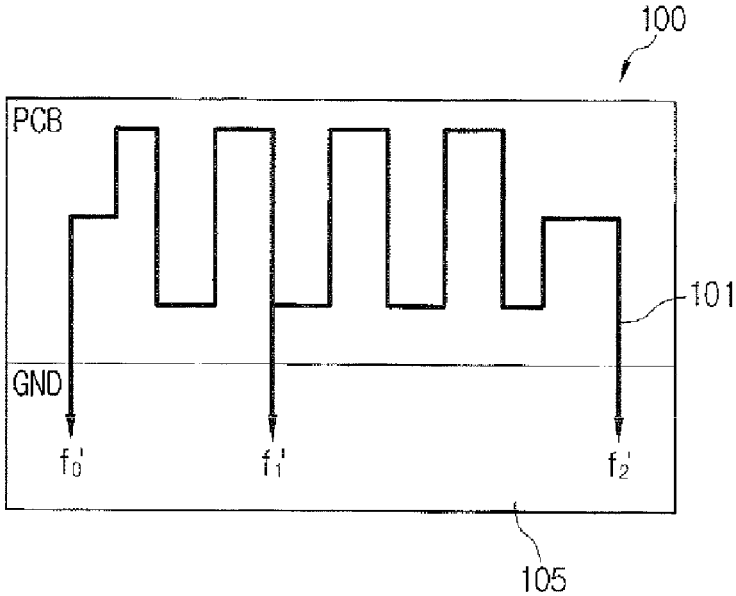
FIG. 4 is a plane view of an antenna of the antenna system of FIG. 3.

FIG. 4 depicts the antenna principle according to an exemplary embodiment of the present invention.

The antenna 100 includes a radiator 101 which is disposed on one side of a circuit board and formed as a strip line bent several times, and a ground 105 which is disposed on another side of the circuit board.

Figure 5:
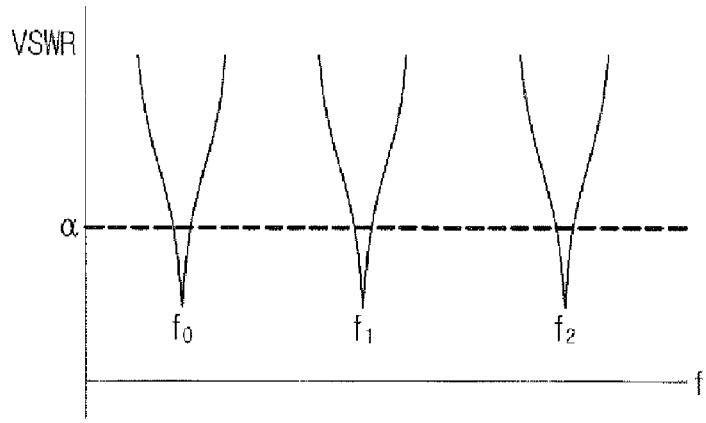
FIG. 5 is a graph showing VSWR of the antenna of FIG. 4.

The radiator 101 is bent zigzag several times to extend its length. A plurality of feed points $f'_0$, $f'_1$, and $f'_2$ are formed in the radiator 101. The feed points are arranged at intervals in the longitudinal direction of the radiator 101. As the strip line of the radiator 101 bends zigzag in parallel, coupling is generated between the strip lines. Hence, as shown in the voltage standing wave ratio (VSWR) graph of FIG. 5, signals measured at the feed points $f'_0$, $f'_1$, and $f'_2$ have the different frequency bands $f_1$, $f_2$, and $f_2$, respectively. Since the signals of the respective frequency bands have the VSWR smaller than a preset threshold a, resonant frequency is generated in each frequency band.

Figure 6:
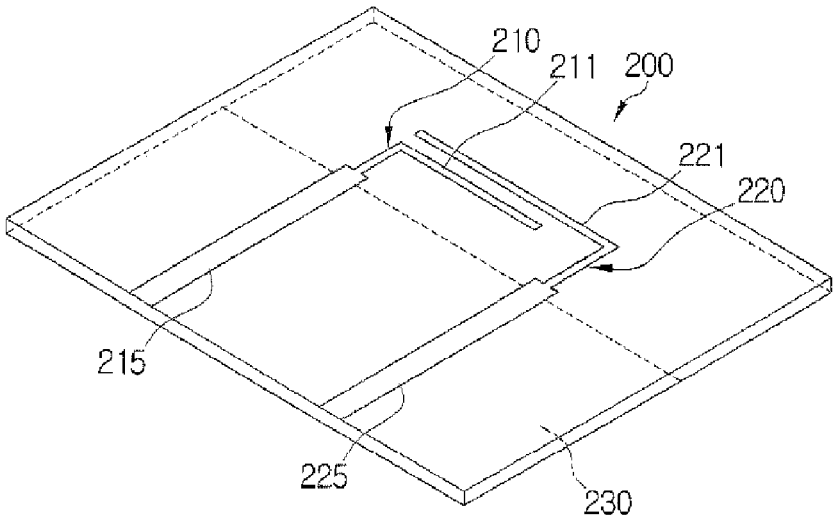
FIG. 6 is a perspective view of an antenna according to an exemplary embodiment of the present invention.

FIG. 6 is a perspective view of an antenna according to one embodiment of the present invention.

The antenna 200 includes radiators 210 and 220 formed on one side of a circuit board, and a ground 230 formed on another side of the circuit board.

The radiators 210 and 220 are formed as first and second radiators 210 and 220 with one side formed as bent strip lines. The first radiator 210 and the second radiator 220 both are bent in an L shape. Herein, the bending area of the first radiator 210 is referred to as a first free end 211, and the bending area of the second radiator 220 is referred to as a second free end 221. When the first free end 211 and the second free end 221 face each other, they overlap by a certain length in parallel with each other.

The lengths of the first radiator 210 and the second radiator 220 are set to $\lambda/4$ of their respective intended operating frequencies. Due to the different lengths of the first and second radiators 210 and 220, their operating frequencies are generated in different frequency bands. Since the first free end 211 and the second free end 221, which are arranged in parallel with each other, generate the mutual coupling, the first radiator 210 and the second radiator 220 generate different operating frequencies separately from the original operating frequencies. That is, the first radiator 210 and the second radiator 220 generate the dual band operating frequencies respectively.

A feed point is formed at the end, facing the ground 230, of the first and second radiators 210 and 220. The feeding points are connected to a pair of ports which are formed lengthwise in parallel along one side of the circuit board. Herein, the port connected to the first radiator 210 is referred to as a first port 215, and the port connected to the second radiator 220 is referred to as a second port 225. The ground 230 is disposed to correspond to the areas of the first port 215 and the second port 225.

Figure 7:
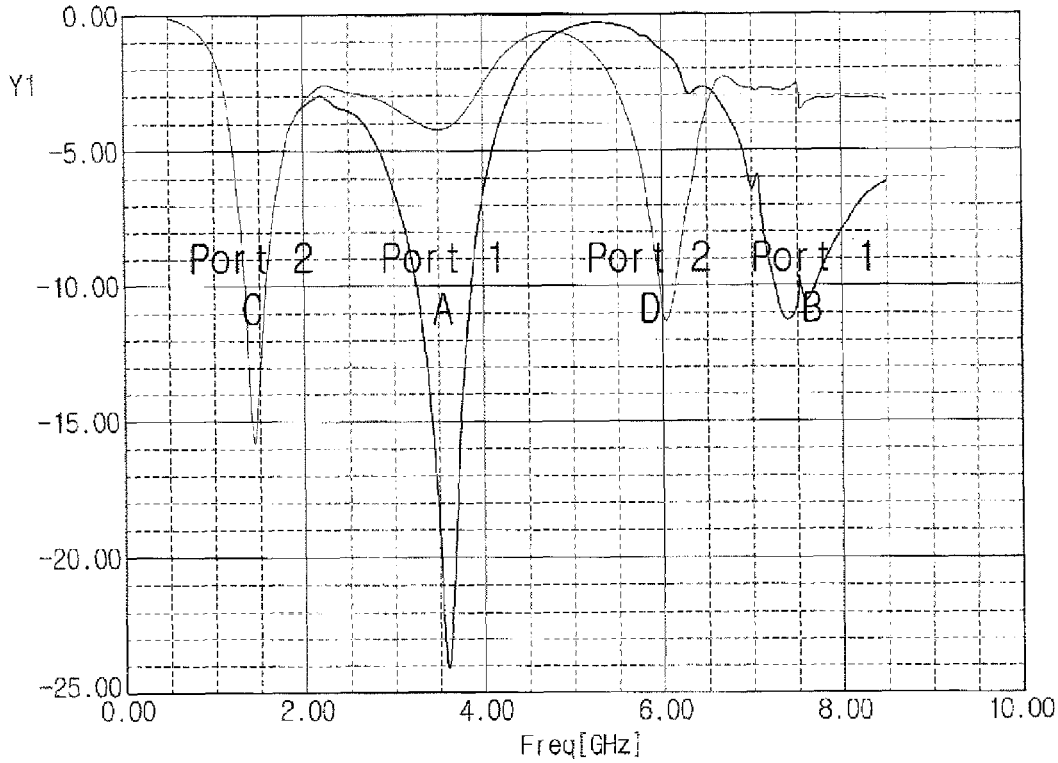
FIG. 7 is a graph showing operating frequencies of the antenna of FIG. 6.

FIG. 7 is a graph showing operating frequencies of the antenna of FIG. 6, wherein Y1 refers to the insertion loss expressed in decibels (dB).

As shown in FIG. 7, dual band operating frequencies indicated by A and B of the first port 215 are generated at the first port 215 linked to the first radiator 210. Dual band operating frequencies indicated by C and D of the second port 225 are generated at the second port 225 linked to the second radiator 220. The operating frequencies of the first radiator 210 are 3.7 GHz and 7 GHz bands, and the operating frequencies of the second radiator 220 are 1.8 GHz and 6 GHz bands.

As one can see from FIG. 7, the first radiator 210 and the second radiator 220 generate their operating frequencies in the different frequency bands. Because of the coupling between the first free end 211 and the second free end 221, the first radiator 210 and the second radiator 220 generate the dual band operating frequencies.

As such, the operating frequencies through the first radiator 210 and the second radiator 220 are generated at the same time. Accordingly, various wireless services corresponding to the respective operating frequency bands can be provided concurrently.

Figure 8A:
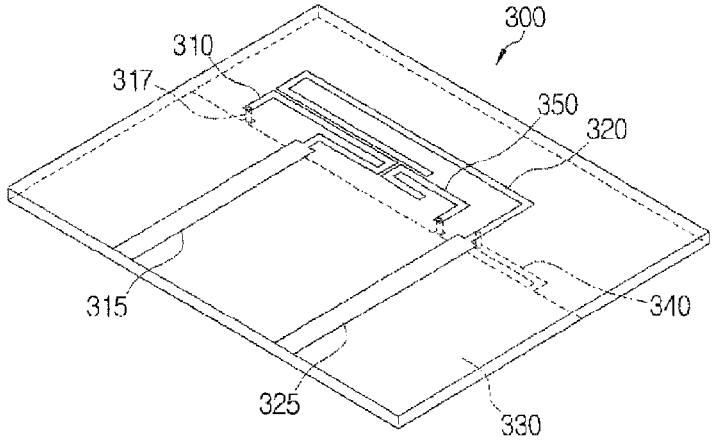
FIG. 8A is a perspective view of an antenna according to another exemplary embodiment of the present invention.
Figure 8B:
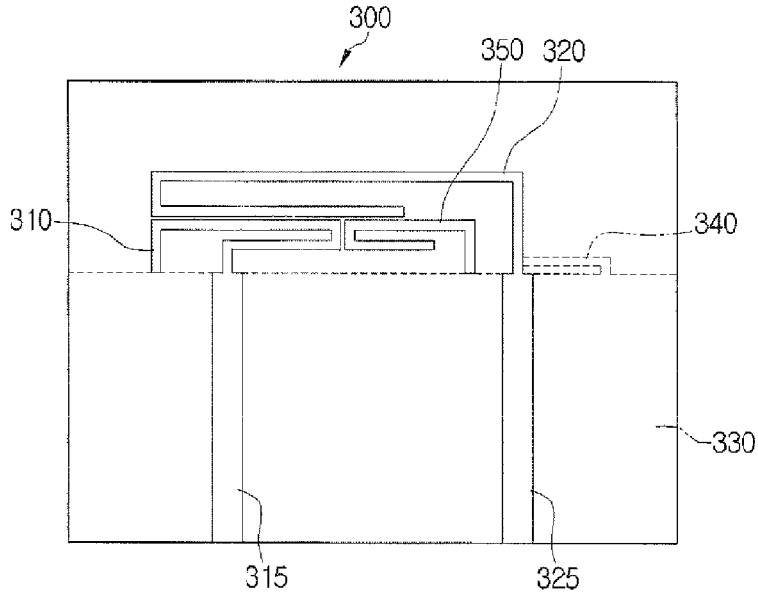
FIG. 8B is a plane view of the antenna of FIG. 8A.

FIG. 8A is a perspective view of an antenna according to another exemplary embodiment of the present invention, and FIG. 8B is a plane view of the antenna of FIG. 8A.

The antenna 300 includes radiators 310, 320, and 350, and a ground 330. The radiators 310, 320, and 350 are first and second radiators 310 and 320, and an auxiliary radiator 350. The first radiator 310 and the second radiator 320 are connected to a first port 315 and a second port 325, respectively, which are formed lengthwise along one side of a circuit board.

The second radiator 320 extends from the second port 325 in the longitudinal direction, bends perpendicularly, extends toward the first port 315, bends downward from the end, and bends toward the second port 325.

The first radiator 310 extends from the first port 315 in the longitudinal direction of the first port 315 and then bends several times in a spiral shape. The first radiator 310 is formed between the second radiator 320 and the first port 315. Part of the strip lines of the first radiator 310 and the second radiator 320 lie in parallel to thus generate the coupling. Thus, the first radiator 310 and the second radiator 320 generate the dual band operating frequencies respectively.

The auxiliary radiator 350 is formed side by side with the first radiator 310 in a symmetrical shape under the second radiator 320. As electromagnetic waves are induced when the first radiator 310 operates, the auxiliary radiator 350 can extend the length of the first radiator 310. Accordingly, the operating frequency of the first radiator 310 is lowered. The auxiliary radiator 350 together with the first radiator 310 generates the coupling with the second radiator 320, thus generating the dual band operating frequency at the second radiator 320.

One end of the first radiator 310, which is not connected to the first port 315, forms a short point connected to the ground 330 through a via hole 317. One end of the auxiliary radiator 350 is also connected to the ground 330 through a vial hole 317 to form a short point. The area of the second radiator 320, connected to the second port 325, is connected to the ground 330 through a via hole 317 to form a short point. In the vicinity of the ground 330, a match part 340 is formed in a strip line shape connected to the ground 330. The via hole 317 interconnects the free end of the match part 340 to the second radiator 320. The match part 340 functions to increase the frequency bandwidth.

The shapes of the first and second radiators 310 and 320 and the auxiliary radiator 350 may vary by bending the strip lines.

Figure 9:
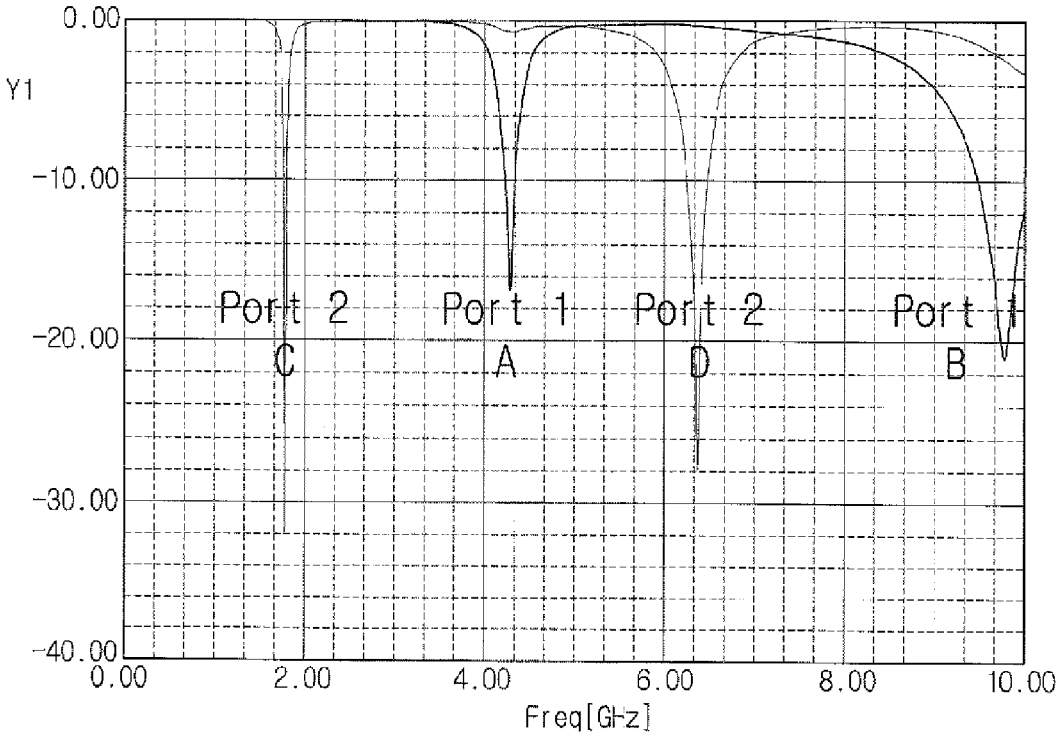
FIG. 9 is a graph showing operating frequencies of the antenna of FIG. 8A.

FIG. 9 is a graph showing operating frequencies of the antenna of FIG. 8A, wherein Y1 refers to the insertion loss expressed in decibels (dB).

Dual band operating frequencies indicated by A and B of the first port 315 are generated in the first port 315 connected to the first radiator 310. Dual band operating frequencies indicated by C and D of the second port 325 are generated in the second port 325 connected to the second radiator 320. The first radiator 310 generates the operating frequencies in a WiBro and WLAN frequency band of 2.3~2.48 GHz and the WLAN frequency band of 5.15~5.825 GHz according to the IEEE 802.11n standard. The second radiator 320 generates its operating frequencies in an mRFID frequency band of 0.9~0.92 GHz and mWiMAX frequency band of 3.4~3.7 GHz.

The first radiator 310 and the second radiator 320 generate their operating frequencies in the different frequency bands. The auxiliary radiator 350 lowers the operating frequency bands of the first radiator 310. Due to the coupling between the first radiator 310 and the second radiator 320, the first radiator 310 and the second radiator 320 respectively generate the dual band operating frequencies.

It is noted that the operating frequencies of the antenna 300 can be changed according to the lengths of the first radiator 310 and the second radiator 320.

FIGS. 10A, 10B, and 10C are plane views of the antenna system to which an open stub, a short stub, an LC circuit are mounted.

By mounting one of an open stub 106, a short stub 107, and an LC circuit 108 in one side of the strip line 101 of the antenna, transmission and reception in a specific frequency band can be blocked. The open stub 106 and the short stub 107 are formed in $\lambda/4$ length of the frequency band to cut off The LC circuit 108 is matched to the frequency band to cut off by adjusting inductance of an inductor and capacitance of capacitor.

By mounting the open stub 106, the short stub 107, and the LC circuit 108 as above, the cut-off between the ports is maximized and a specific frequency, other than the frequency bands transmitted and received by the ports, can be cut off.

FIG. 11 is a plane view of an antenna according to yet another exemplary embodiment of the present invention.

The antenna 400 includes three ports 415. At the end of each port 415, a radiator 410 is formed in a strip line shape. Since a plurality of operating frequency bands is observed through the ports 415, a greater number of the operating frequency bands can be generated.

While every radiator 410 is formed as an L shape, the radiator 410 can be formed in the same shape as the first and second radiators 310 and 320 and the auxiliary radiator 350 in the antenna 300 of FIG. 8A, or can be bent in various shapes.

While three ports are illustrated in the antenna 400 of FIG. 11, the antenna can include a plurality of ports and a plurality of radiators.

By generating the plurality of the operating frequencies using the single antenna 100, the antenna system can not only provide various wireless services corresponding to the respective operating frequency bands on the single antenna but also miniaturize the antenna system. In addition, the antenna system can provide the multi-services at the same time in the concurrent mode which transmits and receives a plurality of radio signals over the respective operating frequency bands at the same time. Furthermore, by removing the BPF and the multiplexer of the conventional antenna system, the insertion loss can be prevented, the structure of the antenna system can be simplified, and the cost can be lowered.

As set forth above, the antenna system can not only provide various wireless services corresponding to the respective operating frequency bands on the single antenna but also miniaturize the antenna system. Furthermore, the antenna system can achieve the insertion loss prevention, the simplified structure, and the lower cost.

While the present invention has been shown and described with reference to exemplary embodiments thereof, it will be understood by those of ordinary skill in the art that changes may be made in these exemplary embodiments without departing from the principles and spirit of the invention, the scope of which is defined by the following claims and their equivalents.

What is claimed is:

1. A concurrent mode antenna system comprising:

an antenna which is configured to resonate at a plurality of operating frequencies that are available at a same time, the antenna comprising:

a circuit board comprising a plurality of feed points provided on one side thereof and a ground plane provided on another side thereof; and a signal processing circuit which comprises a plurality of radio frequency (RF) circuits which process radio signals transmitted and received by the antenna, wherein each of the plurality of the RF circuits corresponds to a respective one of the feed points, and is connected to the respective feed point.

2. The concurrent mode antenna system of claim 1, wherein the antenna further comprises a radiator of a strip line shape connected through the circuit board to the ground plane, and wherein the plurality of feed points are formed in the radiator.

3. The concurrent mode antenna system of claim 2, wherein a port for connecting to the RF circuit is formed to each feed point.

4. The concurrent mode antenna system of claim 2, wherein one of an open stub, a short stub, and an inductor/capacitor (LC) circuit is mounted on one side of the strip line.

5. The concurrent mode antenna system of claim 4, wherein a length of the open stub or the short stub is set to $\lambda/4$ of a frequency to be cut off.

6. The concurrent mode antenna system of claim 4, wherein an inductance of an inductor and a capacitance of a capacitor, that construct the LC circuit, are determined according to the frequencies to be cut off.

7. A concurrent mode antenna system comprising:

an antenna which is configured to resonate at a plurality of operating frequencies that are available at a same time, the antenna comprising:

a ground plane provided on one side of a circuit board;

a radiator of a strip line shape provided on another side of the circuit board and connected to the ground plane; and a plurality of feed points, which are formed in the radiator; and a signal processing circuit which is connected to the feed points and processes radio signals transmitted and received by the antenna, wherein the radiator comprises:

a first radiator comprising a first strip line including a first bent portion; and a second radiator comprising a second strip line including a second bent portion, which extends in parallel to the first bent portion and overlaps the first bent portion by a certain length, wherein the first strip line, the first bent portion, the second strip line, and the second bent portion are provided in the same plane on the another side of the circuit board.

8. The concurrent mode antenna system of claim 7, wherein a port is connected to one of the ends of the first radiator and the second radiator.

9. The concurrent mode antenna system of claim 7, wherein the first radiator is formed by bending the strip line in a spiral-like shape.

10. The concurrent mode antenna system of claim 7, further comprising:

an auxiliary radiator formed symmetrical to and in parallel with the first radiator, wherein the auxiliary radiator generates a coupling with the first radiator.

11. The concurrent mode antenna system of claim 10, wherein the second strip line bends several times around the first radiator and the auxiliary radiator, and the second radiator generates a coupling with the first radiator and the auxiliary radiator.

12. A concurrent mode antenna system comprising:

an antenna which is configured to resonate at a plurality of operating frequencies that are available at a same time, the antenna comprising:

a dielectric substrate;

a ground;

a radiator of a strip line shape connected to the ground, the ground and the radiator being respectively disposed on opposite sides of the dielectric substrate; and a plurality of feed points, which are formed in the radiator;

a signal processing circuit which is connected to the feed points and processes radio signals transmitted and received by the antenna; and a match part which is formed as a strip line extending from one side of the ground, and electrically connected to the radiator through a via hole penetrating the dielectric substrate.

* * * * *